US006510787B2

(12) United States Patent
Douville

(10) Patent No.: US 6,510,787 B2
(45) Date of Patent: Jan. 28, 2003

(54) PRINTING MACHINE FOR PRINTING BOTH SIDES OF FLAT OBJECTS

(75) Inventor: Jean-Pierre Douville, Gagny (FR)

(73) Assignee: Les Machines Dubuit, Noisy le Grand (FR)

( * ) Notice: Subject to any disclaimer, the term of this patent is extended or adjusted under 35 U.S.C. 154(b) by 0 days.

(21) Appl. No.: 09/901,697

(22) Filed: Jul. 11, 2001

(65) Prior Publication Data

US 2002/0017206 A1 Feb. 14, 2002

(30) Foreign Application Priority Data

Jul. 11, 2000 (FR) ..... 00 09042

(51) Int. Cl.[7] ..... B41F 17/00
(52) U.S. Cl. ..... 101/35; 101/126; 414/773
(58) Field of Search ..... 101/35, 37, 41, 101/42, 43, 44, 126; 414/27, 773, 783, 908

(56) References Cited

U.S. PATENT DOCUMENTS 4,143,776 A * 3/1979 Meyers et al. ..... 101/37
5,141,388 A * 8/1992 Georgitsis et al. ..... 414/728
5,520,106 A * 5/1996 Karlyn et al. ..... 101/126
5,520,107 A * 5/1996 Airoldi ..... 101/115

FOREIGN PATENT DOCUMENTS

| | | |
|---|---|---|
| EP | 0 889 467 | 1/1999 |
| FR | 2 714 867 | 7/1995 |

* cited by examiner

*Primary Examiner*—Andrew H. Hirshfeld
*Assistant Examiner*—Jill E Culler
(74) *Attorney, Agent, or Firm*—Young & Thompson

(57) ABSTRACT

A printing machine includes a circular contour printing table which has a plurality of object-stations regularly distributed around its periphery each adapted to receive an object to be printed and which, rotatable stepwise about an axis, moves the object-stations successively to a loading station, to a plurality of workstations each including a printing system, and to an offloading station. A system for turning over the objects includes a first transfer arm which picks up an object on the printing table and puts it down on an overturning shovel, turns it over and puts it down at a receiving station. A second transfer arm picks up the turned-over object at the receiving station and puts it back down on the printing table.

17 Claims, 5 Drawing Sheets

PRIOR ART FIG.1
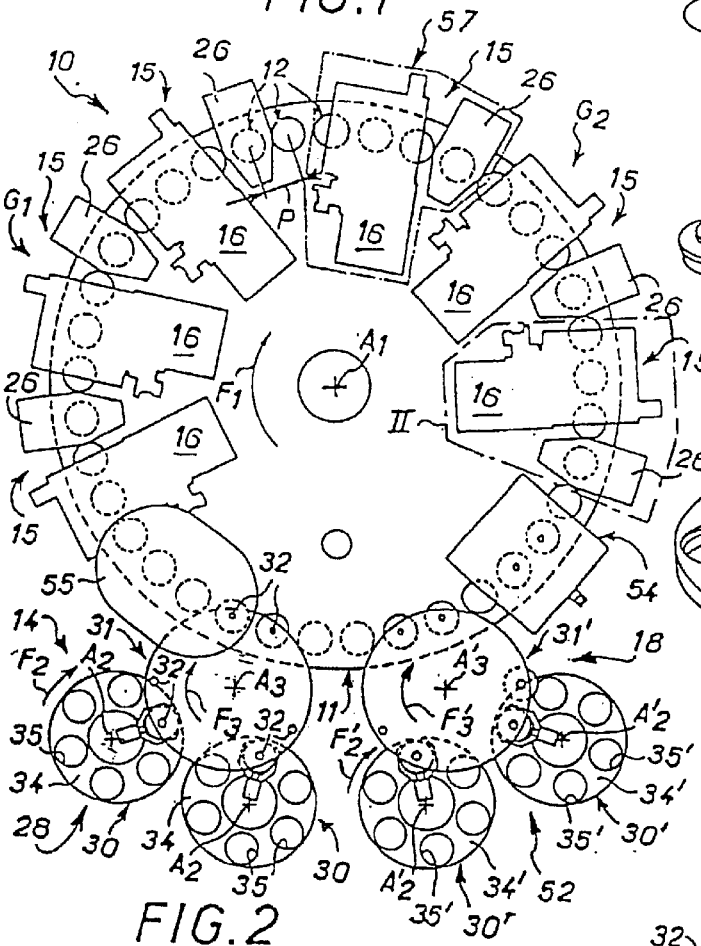
FIG.2
PRIOR ART
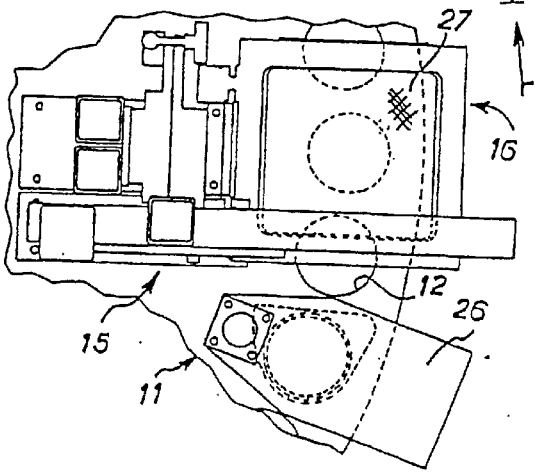
FIG.3
PRIOR ART
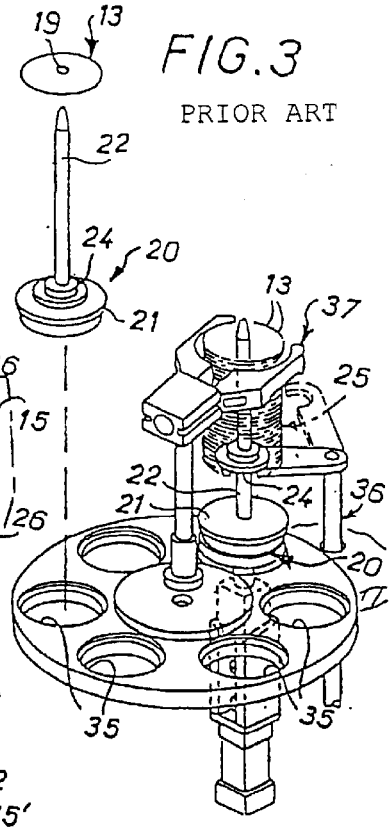
FIG.4 PRIOR ART
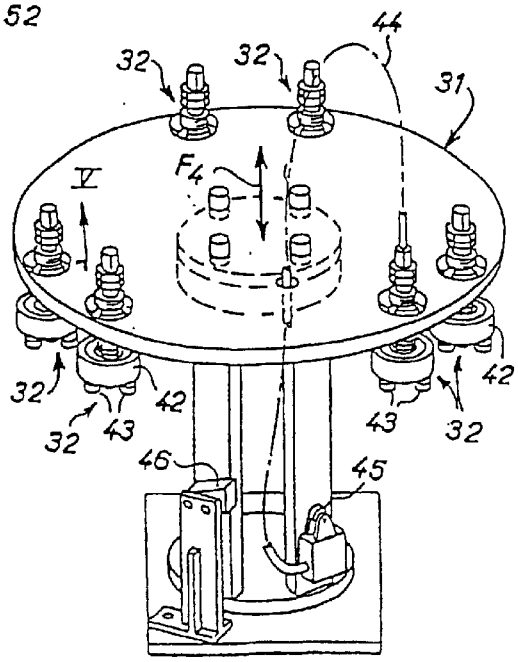

11
12
61
62
63
64
65
66
67
68
69
70
75
76
78
X
X

PRINTING MACHINE FOR PRINTING BOTH SIDES OF FLAT OBJECTS

BACKGROUND OF THE INVENTION

1. Field of the Invention

The present invention relates generally to printing objects that can be stacked, for example compact disks and digital versatile disks.

2. Description of the Prior Art

The present invention addresses the situation in which a printing machine used to print such objects includes a circular contour printing table with a plurality of object-stations distributed around its periphery each adapted to receive an object to be printed. Mounted to rotate stepwise about a vertical axis, it moves the object-stations successively to a loading station, to a plurality of workstations each including printing means, and to an offloading station. A loading system at the loading station includes a presentation system adapted to feed at least one stack of objects to the loading station and a transfer system operative between the presentation system and the printing table and equipped with at least one pick-up unit adapted to pick up an object from the stack on the presentation system and place that object on one of the object-stations of the printing table.

In practice there is usually one workstation for each color to be printed and, at the loading station, the transfer system of the loading system takes up the objects on the presentation system one by one and puts them down on the printing table one by one.

The overall rate of production is therefore determined by the rate of operation of the loading system.

The document FR-A-2 714 867 describes a printing machine which is of the kind described above and in which the loading system at the loading station includes two presentation systems for the same transfer system; the transfer system includes at least one pair of pick-up units disposed side-by-side one of which co-operates with one presentation system and the other of which cooperates with the other presentation system, in succession.

The transfer system therefore picks up an object to be printed from each presentation system in succession and then puts down the two objects to be printed that it has picked up in this way on the printing table simultaneously.

Assuming that the number of workstations is an even number 2N, it is therefore advantageously possible to print N colors on two objects at a time during one and the same rotation of the printing table, half of the workstations successively printing the same object while the other half of the workstations are successively printing another object at the same time.

The overall rate of production is therefore doubled, which is to the benefit of productivity.

Alternatively, on this kind of printing machine, assuming that the number of object-stations on the printing table is odd and that the working area of each workstation corresponds to an even number of object-stations, it is advantageously possible to print 2N colors successively on one object at a time using the 2N workstations and in the course of two successive rotations of the printing table.

The production rate is halved compared to the previous rate, but the printing machine then has the advantage of being more flexibly adaptable to different printing conditions, for example the number of objects to be printed during the same run and/or the number of colors to be printed on the objects.

In practice, an offloading system is used at the offloading station and is of similar design to the loading system; the offloading system includes a transfer system and, associated therewith to provide the possibility of doubling up production, two evacuation systems which are of the same type as the presentation systems of the loading system and each of which is adapted to accumulate at least one stack of objects and to move it away from the offloading station.

In a process that is similar to that previously described for the loading station, the transfer system simultaneously picks up from the printing table two objects that have already been printed and normally releases one of them at one evacuation system and the other at the other evacuation system.

An object of the present invention is to enable a machine of the above type to print both sides of an object such as a digital versatile disk.

SUMMARY OF THE INVENTION

A printing machine in accordance with the invention includes a circular contour printing table which has a plurality of object-stations regularly distributed around its periphery each adapted to receive an object to be printed and which, rotatable stepwise about an axis, moves the object-stations successively to a loading station, to a plurality of workstations each including a printing system, and to an offloading station, wherein it is associated with a system for turning over the objects which includes a first transfer arm adapted to pick up an object on the printing table and put it down on an overturning shovel which is adapted to turn it over and to put it down at a receiving station and a second transfer arm adapted to pick up the turned-over object at the receiving station and to put it back down on the printing table.

The transfer arms are advantageously separated by a distance at least equal to the pitch of the object-stations.

Each transfer arm is preferably carried by a carriage sliding on a rail and the transfer arm slides vertically on the carriage.

Each carriage is advantageously coupled to a link rotatable about an axis carried by the carriage and whose end opposite that by which the carriage is coupled to it is articulated to a crank driven by an electric motor.

The axis of the link is preferably offset relative to the plane in which the arm slides vertically.

The transfer arm is advantageously caused to slide vertically by a link coupled at one end to the arms and at the other end to the end of the link.

The two cranks are preferably opposed and parallel so that when the first transfer arm is closest to the periphery of the printing table 11 the second arm is farthest away from it.

The two cranks are advantageously driven by a single electric motor.

The overturning shovel is preferably rotatable about the axis of a gear motor adapted to cause the overturning shovel to assume two positions spaced by 180°, that is to say a receiving position and a feed position.

The free end of the overturning shovel advantageously carries suction nozzles.

The electric motors are preferably digitally controlled brushless motors.

The printing machine preferably includes a loading system at the loading station which includes a presentation system adapted to feed at least one stack of objects to the loading station and a transfer system operative between the presentation system and the printing table and equipped with at least one pick-up unit adapted to pick up an object on the stack present on the presentation system and then to put that object down on one of the object-stations of the printing table.

The transfer system advantageously has three pickup units spaced by 120°.

The presentation system preferably includes a circular contour plate rotatable stepwise about an axis parallel to the rotation axis of the printing table and having a plurality of circumferentially distributed object-stations each adapted to receive a stack support.

The printing machine advantageously includes an off-loading system at the offloading station of similar construction to the loading system, the offloading system including a transfer system and associated therewith an evacuation system adapted to accumulate at least one stack of objects and to move it away from the offloading station.

The printing machine preferably includes an even number of workstations.

The printing table advantageously has an odd number of object-stations and the working area of each workstation corresponds to an even number of object-stations.

The features and advantages of the invention will become apparent from the following description, which is given by way of example and with reference to the accompanying diagrammatic drawings.

BRIEF DESCRIPTION OF THE DRAWINGS

FIG. 1 is a plan view of a prior art printing machine.

FIG. 2 shows the detail II from FIG. 1 to a larger scale.

FIG. 3 is an exploded perspective view to a still larger scale of an object to be printed, a stack support adapted to receive the objects to be printed, and a presentation system adapted to receive the stack support.

FIG. 4 is a perspective view of the corresponding transfer system to substantially the same scale as FIG. 3.

DETAILED DESCRIPTION OF THE PREFERRED EMBODIMENTS

Figure 5:
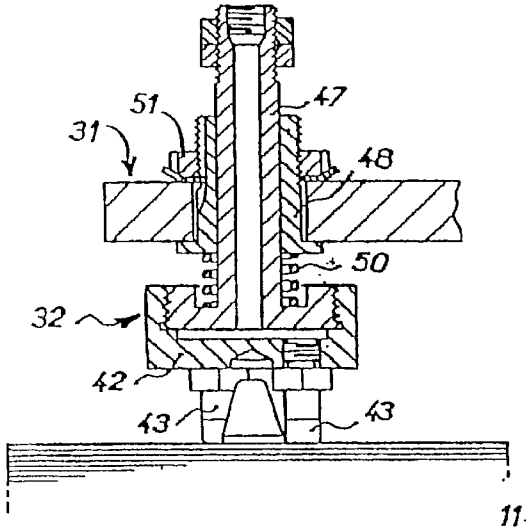
FIG. 5 PRIOR ART
FIG. 5 is a partial view of the transfer system to a larger scale and in cross section taken along the line V—V in FIG. 4.

As shown in FIG. 1, the printing machine 10 in accordance with the invention includes a circular contour printing table 11 which has a plurality of object-stations 12 regularly distributed around its periphery, each of which is adapted to receive an object 13 to be printed. Rotatable stepwise about an axis A1 passing through its center and perpendicular to its plane, and in practice vertical, it moves the object-stations 12, for example in the clockwise direction indicated by the arrow F1 in FIG. 1, successively to a loading station 14, a plurality of workstations 15 each including a printing system 16, and an offloading station 18.

Any objects 13 adapted to be stacked can be printed.

In the embodiments shown, they are in practice flat objects, to be more precise compact disks with a central opening 19.

Stack supports 20 are used for stacking the objects 13. As shown in FIG. 3, a stack support 20 has a base 21, a pillar 22 fastened to the base 21, projecting axially from the base and tapered at the top so that the central opening 19 of the objects 13 can be threaded over it, and a ring 24 slidably mounted on the pillar 22.

This kind of stack support 20 is well known in the art and does not of itself constitute the subject matter of the present invention. For this reason it is not described in more detail here. In use, it carries a stack 25 of objects 13 which in practice rest on the ring 24.

The printing machine 10 is not described in complete detail here either.

Only its components necessary to understanding the invention are described.

In the embodiment shown, the printing machine 10 includes an even number 2N of workstations 15, for example, as shown here, 2N=6 workstations.

The printing table 11 has an odd number of object-stations 12, significantly greater than the number of workstations 15. For example, as shown here, there are 37 object-stations 12.

Be this as it may, the object-stations 12 are spaced with a regular pitch P.

The workstations 15 are all identical and each includes a drying system 26 in addition to a printing system 16 and downstream of the printing system 16 in the direction of rotation of the printing table 11.

The printing system 16 forms a screenprinting station, for example.

Because this kind of screenprinting station is well known in the art, suffice to say that it includes a screen 27, a squeegee, not visible in the figures, for pushing over the screen 27 the ink intended to pass through it, and an actuator system for moving the squeegee along the screen 27, raising it relative to the screen 27, and raising the screen 27 itself.

The drying system 26 consists of an ultraviolet oven, for example.

In practice, the working area of a workstation 15 on the printing table 11 corresponds to an even number of object-stations 12.

For example, and as shown here, there are four object-stations, the printing system 16 subtends an angle equivalent to three object-stations 12, and thus equivalent to three times the pitch P, and the drying system 26 is equivalent to one object-station 12 and therefore to one pitch P.

The workstations 15 are therefore divided into two groups G1, G2 separated by one pitch P, in the form of a free object-station 12. In the embodiment shown, each of the two groups G1, G2 includes the same number N of workstations 15. In this example N=3.

A loading system 28 at the loading station 14 includes a presentation system 30 which, by means of a stack support 20, is adapted to feed to the loading station 14 at least one stack 25 of objects 13, and a transfer system 31 operative between the presentation system 30 and the printing table 11 and equipped with at least one pick-up unit 32 adapted to pick up the object 13 at the top of the stack 25 on the presentation system 30, and then to put that object 13 down on one of the object-stations 12 of the printing table 11. All this is known in the art.

The presentation system 30 includes a circular contour plate 34 rotatable stepwise about an axis A2 parallel to the rotation axis A1 of the printing table 11, for example in the clockwise direction indicated by the arrow F2 in FIG. 1. It has a plurality of circumferentially distributed object-stations 35 each adapted to receive a stack support 20.

Although not described in detail here, this embodiment of the presentation system 30 further includes a lifting system 36 for lifting the stack 25 step by step as objects 13 are picked off it, by means of the ring 24 on which the stack 25 rests, and a retaining system 37 for retaining a reserve of objects 13 on changing the stack support 20 by advancing the plate 34 by one step.

The transfer system 31 consists of a circular contour plate rotatable stepwise about an axis A3 parallel to the rotation axis A1 of the printing table 11, for example in the clockwise direction indicated by the arrow F3 in FIG. 1. It can also be reciprocated vertically relative to the printing table 11, as indicated by the double-headed arrow F4 in FIG. 4.

These figures show the locations of the rotation axes A1, A2, A3.

The presentation system 30 and the transfer system 31 are actuated in a stepwise manner by indexers, not shown, for example, synchronously with the movement of the printing table 11.

These arrangements are well known in the art and are not relevant to the present invention, so they are not described here.

For the same transfer system 31, the loading system 28 can include two presentation systems 30 disposed side-by-side at the periphery of the transfer system 31, and in practice identical to each other, and at least two pairs of pick-up units 32 disposed side-by-side at the periphery of the transfer system 31 and one co-operating with one presentation system 30 and the other co-operating with the other presentation system in succession.

Figures 6A, 6B, 6C:
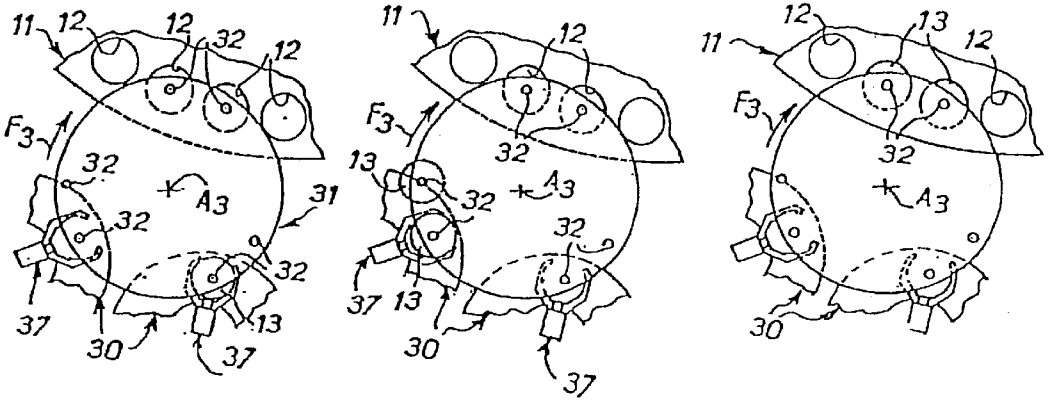
FIG. 6A PRIOR ART FIG. 6B PRIOR ART FIG. 6C PRIOR ART
FIGS. 6A, 6B, 6C are plan views reproducing part of FIG. 1 and illustrating various phases in the operation of the printing machine.

In this case, as shown in FIGS. 6A, 6B, the pick-up unit 32 of the same pair that is at the front in the direction of rotation of the transfer system 31 cooperates with the first presentation system 30 in the same rotation direction (FIG. 6A) and the pick-up unit 32 at the rear cooperates with the second presentation system 30 (FIG. 6B). In other words, the transfer system 31 is first lowered so that the first pick-up unit 32 can pick up an object 13 on the first presentation system 30, in line with its retaining system 37 (FIG. 6A), and then, after it has been raised and advanced by one step, it is lowered again so that its second pick-up unit 32 can pick up an object 13 on the second presentation system 30, in line with its retaining system 37 (FIG. 6B).

After it has been raised and advanced again by one step, the transfer system 31 then puts the two objects 13 that it has previously picked up down simultaneously on the printing table 11, as shown in FIG. 6C.

Note that when the first object 13 is picked up, the second pick-up unit 32 is empty and when the second object 13 is picked up the object 13 previously picked up is suspended from the pick-up unit 32 which picked it up.

In practice the transfer system 31 can have several pairs of circumferentially distributed pick-up units 32.

In the embodiment shown, it has three pick-up units 32 spaced by 120° and each stepwise advance therefore corresponds to a rotation of 120°.

In the embodiment shown, the pick-up units 32 operate by suction.

To this end, each of them include a head 42, see FIGS. 4 and 5, which has a plurality of suction nozzles 43 on its bottom surface and regularly distributed about its axis, for example three nozzles, which communicate with a pipe 44 for connecting them all to a suction pump, not shown.

The pipe 44 for each pick-up unit 32 includes a valve 45 which is actuated in passing by a fixed cam 46.

In practice the head 42 is carried by a rod 47 sliding in a bush 48 carried by the transfer system 31 (see FIG. 5), and is acted on by a spring system 50, for example a coil spring, which bears on the bush 48 and urges it downward at all times.

For example, as shown here, the rod 47 incorporates a shoulder and is clamped to the transfer system 31 by a nut 51.

Be this as it may, the rod is hollow to provide communication between the suction nozzles 43 and the associated pipe 44.

The printing machine 10 can further include an offloading system 52 at the offloading station 18 which is of similar design to the loading system 28 at the loading station 14.

The offloading system 52 therefore includes a transfer system 31' with pick-up units 32 associated with two evacuation systems 30' each adapted to accumulate at lest one stack 25 of objects 13 and move it away from the offloading station 18.

The transfer system 31' is entirely similar to the transfer system 31 of the loading station 14.

It rotates stepwise about a vertical axis A'3, in the clockwise direction, as previously, and as indicated by the arrow F'3 in FIG. 1.

Similarly, the evacuation systems 30' are similar to the presentation system 30.

They therefore include a circular contour plate 34' rotatable stepwise about a vertical axis A'2, in practice in the clockwise direction indicated by the arrow F'2 in FIG. 1. They have a plurality of circumferentially distributed object-stations 35' each adapted to receive a stack support 20.

There is an inspection station 54 equipped with video cameras, for example, for checking the printing upstream of the loading station 14, between it and the last workstation 15.

Similarly, in the embodiment shown, there is an inspection station 55 for checking that the objects 13 are those expected, for example by reading off a serial number, between the loading station 14 and the first workstation 15.

In operation, the steps by which the printing table 11 advances are equal to twice the pitch P between two object-stations 12.

For double production, the two presentation systems 30 of the loading system 28 and the two evacuation systems 30' of the offloading system 52 are in service.

By the process previously described, the objects 13 to be printed are put down two by two on the printing table 11, from which they are removed two by two after printing by a similar process.

The even-numbered objects 13 are successively printed at each workstation 15 of the first group G1; the odd-numbered objects 13 are successively printed at each workstation 15 of the second group G2.

All of them are printed during a single rotation of the printing table 11.

However, they can be printed differently in each of the two groups G1, G2 of workstations 15.

In other words, the printing machine 10 can print two series of objects 13 simultaneously and in parallel, the objects of a first series receiving a first type of printing and those of the other series receiving a second type of printing, which can be different from the first type of printing.

Alternatively, for printing six colors, for example, and thus for single production, only one of the presentation systems 30 of the loading system 28 and only one of the evacuation systems 30' of the offloading system 52 are in service.

During a first rotation of the printing table 11 the successive objects 13 receive one color, or more generally one printing, at each workstation 15 of the first group G1; during a second rotation of the printing table 11 they then successively receive a color, or more generally one printing, at each workstation 15 of the second group G2.

In single production, the invention provides for printing a first face of an object during a first rotation of the printing table 11 using the workstations 15 of the first group G1 and printing the second face of the object during a second rotation using the workstations 15 of the second group G2.

FIGS. 7 to 11 show that the machine just described is associated with an overturning system that essentially comprises a first transfer arm 61, an overturning member 62 referred to hereinafter as the overturning shovel 62, and a second transfer arm 63.

The overturning shovel 62 rotates about the axis 65 of a gear motor 66.

In the embodiment shown, the end of the overturning shovel 62 is generally V-shaped and carries three suction nozzles 64.

Figure 7:
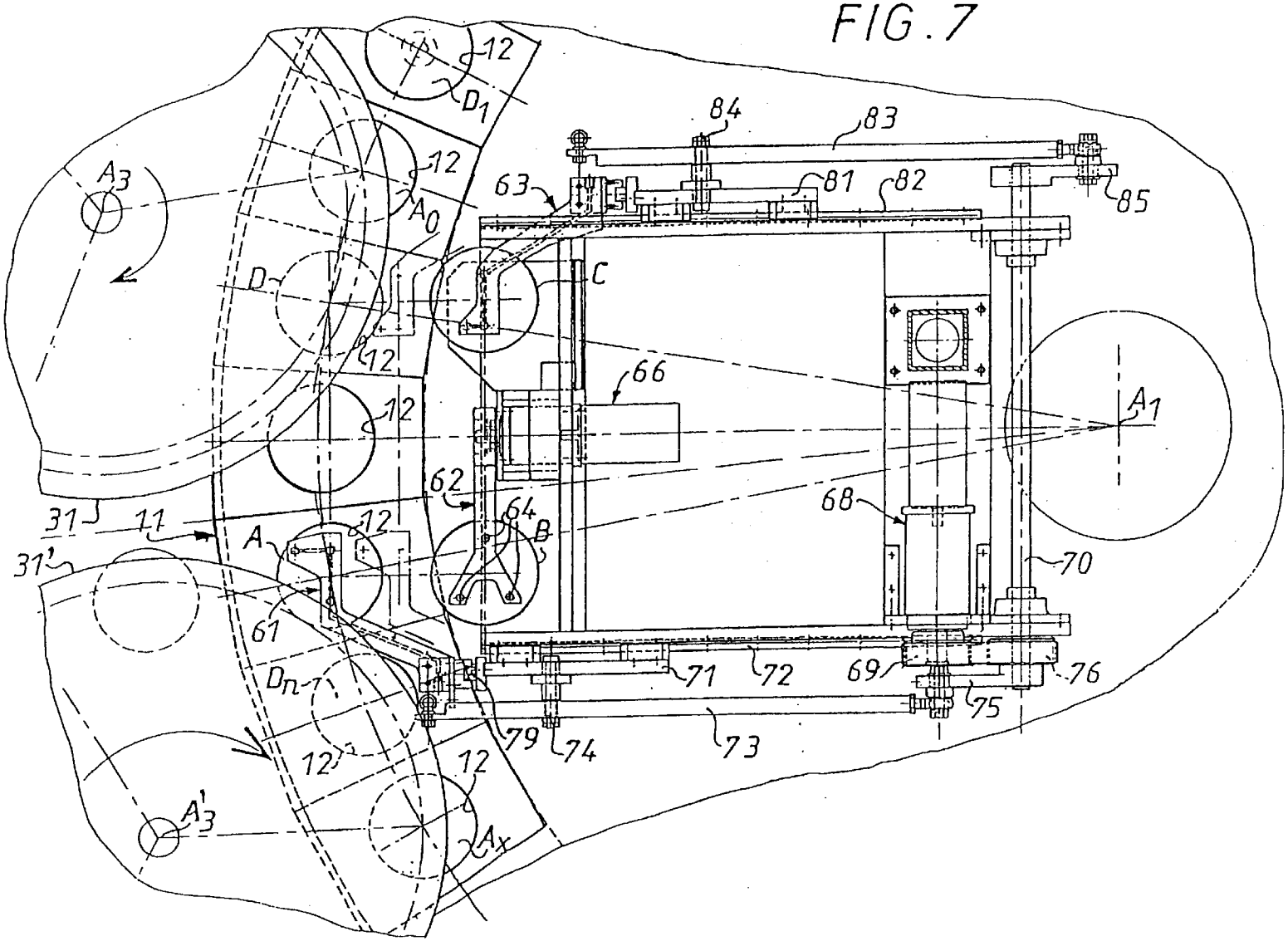
FIG. 7 is a plan view which shows an overturning system in accordance with the invention.
Figures 8, 9, 10:
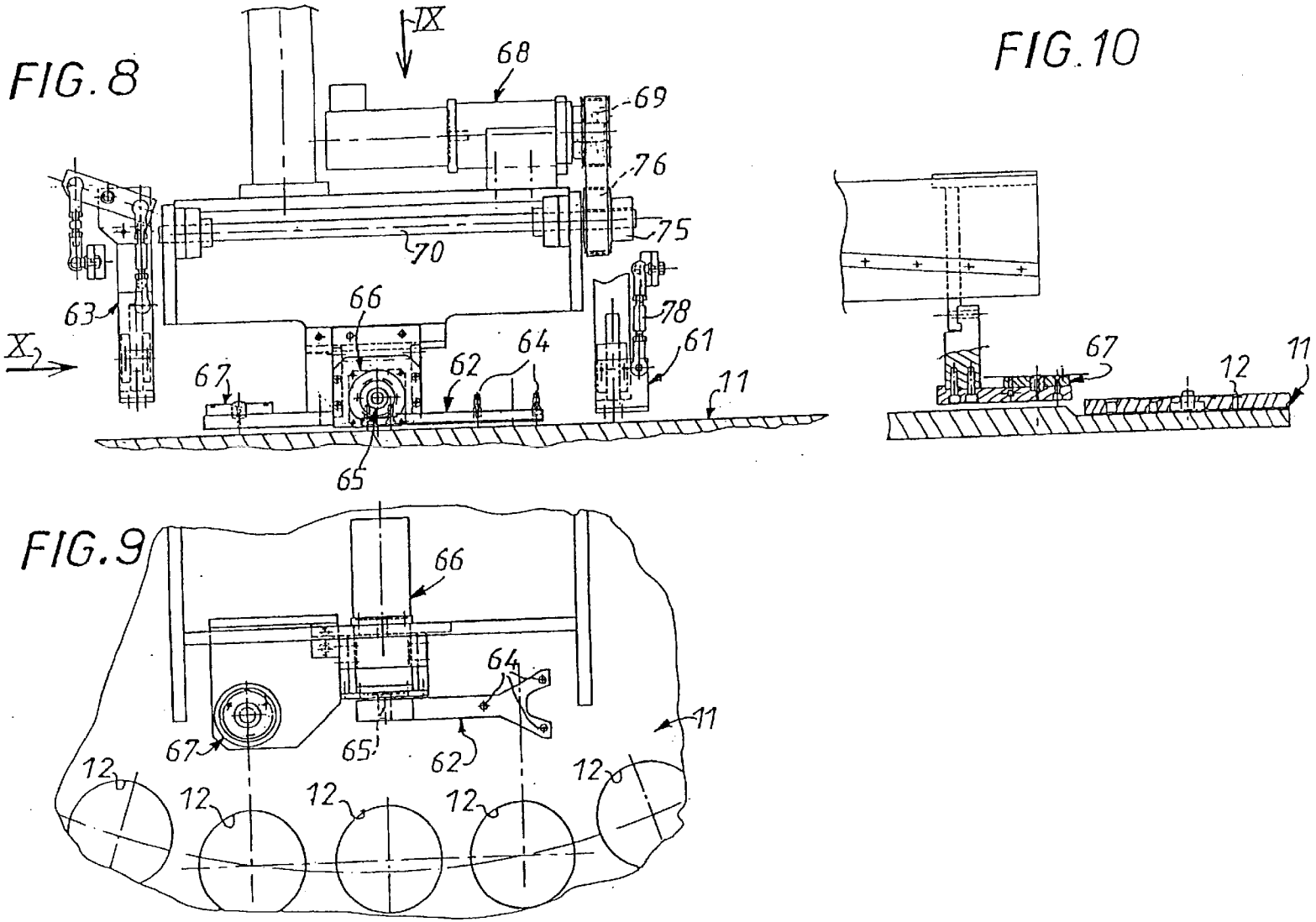
FIG. 8 is a partial elevation view of the machine shown in FIG. 7.
FIGS. 9 and 10 are partial views in the direction of the arrow IX and X, respectively, in FIG. 8.
Figure 11:
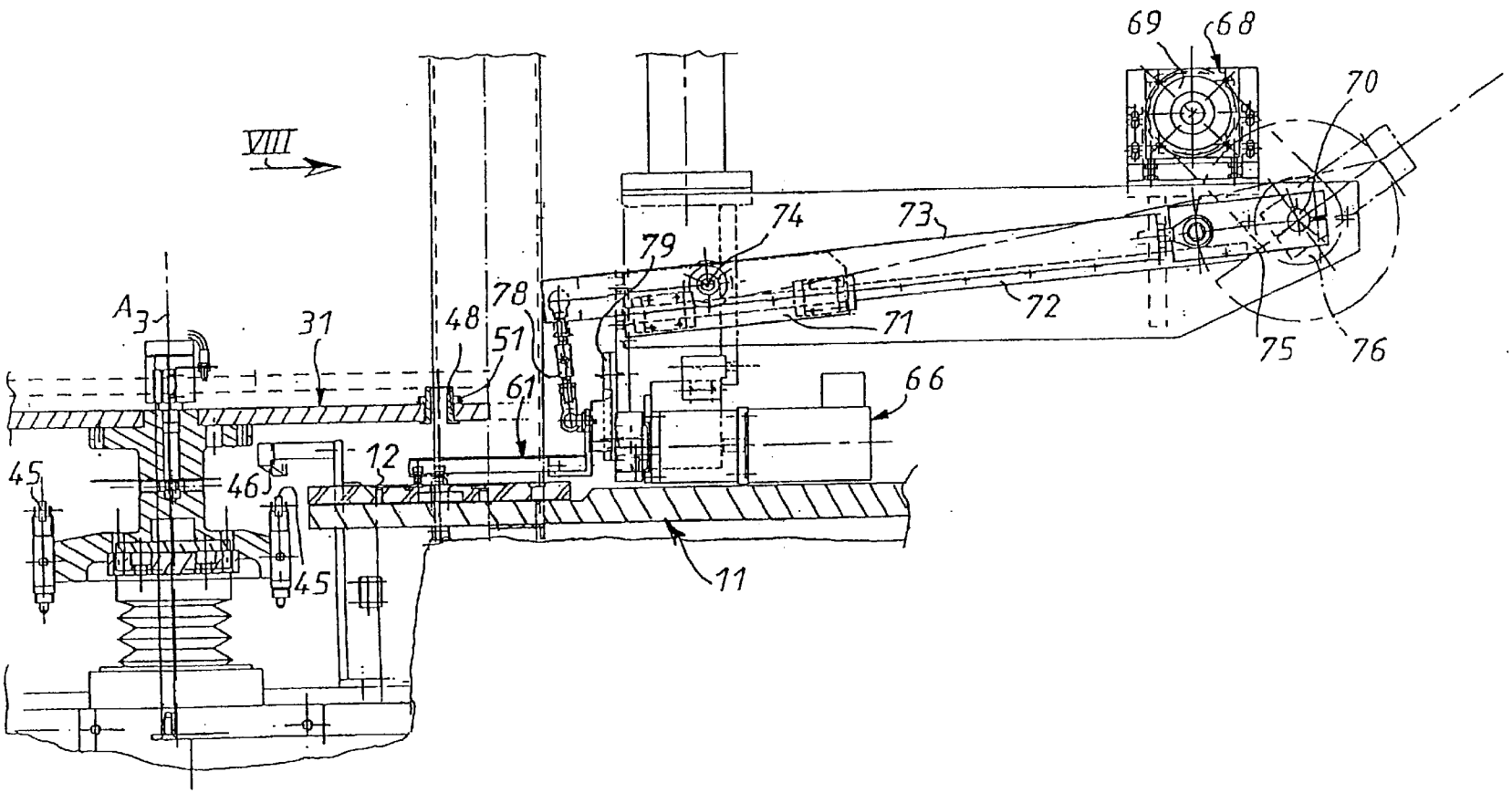
FIG. 11 is a view as seen from the right-hand side of FIG. 7.

The gear motor 66 can move the overturning shovel 62 between at least the following two positions: a receiving position shown in FIGS. 7, 8 and 9, in which the suction nozzles 64 open onto the top of the overturning shovel 62, and a supply position, 180° from the previous position, and symmetrical to it about the axis 65, in which the suction nozzles 64 face a receiving station 67.

The transfer arms 61 and 63 are separated by a distance at least equal to P, and in this example equal to 2P; they are driven by a gear motor through a system of cranks and links.

To be more precise, the first transfer arm 61 is carried by a carriage 71 sliding on a rail 72 that is slightly inclined to the printing table 11, on which carriage it can slide vertically; it is coupled to a link 73 rotatable about an axis 74 carried by the carriage 71 and whose end opposite that at which the carriage 71 is coupled to it is articulated to a crank 75 constrained to rotate with a driven pulley 76 driven by a belt from a driving pulley 69 driven by the electric motor 68; the axis 74 of the link 73 is offset relative to the plane in which the arm 61 slides vertically; it is caused to slide vertically by a link 78 coupled at one end to the arm 61 and at the other end to the end of the link 73; the arm 61 is mounted on a slider 79 carried by the carriage 71; this is a simple way to obtain movement of the transfer arm 61 in translation in the heightwise direction at the end of its travel.

The driven pulley 76 is fastened to the end of a shaft 70 that carries at its other end a crank 85 associated with a link 83 rotatable about a pivot 84 carried by a carriage 81 sliding on a rail 82 parallel to the rail 81; the second transfer arm 63 is connected to the link 83 and to the carriage 81 in the same way as the first transfer arm 61 but, as can be seen in FIG. 7, the cranks 75 and 85 are connected to the shaft 70 oppositely and in parallel so that when the first arm 61 is nearest the periphery of the printing table 11 the second arm 63 is farthest away from it.

It can be seen that the two cranks 75, 85 are driven by a single electric motor 68.

The ends of the two arms 61 and 63 have respective suction nozzles 77 and 87 facing the printing table 11.

The first transfer arm 61 picks up an object at A on the printing table 11 (FIG. 7) and puts it down at B on the overturning shovel 62. The second transfer arm 63 picks up an object at C on the receiving station 67 (FIG. 9) and puts it down at D on the receiving table; obviously, the object at C is an object picked up at B by the overturning shovel 62 and then turned over by it.

Other positions are identified in FIG. 7; the position D1 downstream of D corresponds to the object that was turned over before the one that corresponds to D and Ao corresponds to the placing of an object by the loading transfer system 31, which undergoes its first turn for its first printing.

The position AX upstream of A corresponds to an object that has been printed on its first face and that will be turned over when it reaches A; Dn corresponds to an object that has undergone both its turns, and which has therefore been printed on both sides, and which will be offloaded by the transfer system 31'.

The position between A and D on the axis of the motor 66 is still empty.

The electric motors 66, 68 are advantageously numerically controlled brushless motors; operating the motors in tracking mode facilitates synchronizing the movements of the mechanical components, in particular of the transfer arms 41 and 63, the overturning system 13 and the printing table 11.

There is claimed:

1. A printing machine including a circular contour printing table which has a plurality of object-stations regularly distributed around its periphery each adapted to receive an object to be printed and which, rotatable stepwise about an axis, moves said object-stations successively to a loading station, to a plurality of workstations each including a printing system, and to an offloading station, said printing machine comprising a system for turning over said objects which includes a first transfer arm adapted to pick up one of said objects on said printing table and put it down on an overturning shovel which is adapted to turn it over and to put it down at a receiving station and a second transfer arm adapted to pick up the turned over object at said receiving station and to put it back down on said printing table.

2. The printing machine claimed in claim 1, wherein said transfer arms are separated by a distance at least equal to the pitch of said object-stations.

3. The printing machine claimed in claim 1, wherein each transfer arm is carried by a carriage sliding on a rail and slides vertically on said carriage.

4. The printing machine claimed in claim 3, wherein each carriage is coupled to a first link rotatable about an axis carried by said respective carriage and whose end opposite that by which said respective carriage is coupled to said respective link is connected to a crank driven by an electric motor.

5. The printing machine claimed in claim 4, wherein the axis of each said link is offset relative to the plane in which said respective transfer arm slides vertically.

6. The printing machine claimed in claim 5, wherein each said transfer arm is caused to slide vertically by a second link coupled at one end to said respective transfer arm and at the other end to the end of said respective link.

7. The printing machine claimed in claim 4, wherein said two cranks are opposed and parallel so that when said first transfer arm is closest to the periphery of said printing table said second transfer arm is farthest away from it.

8. The printing machine claimed in claim 4, wherein said two cranks are driven by a single electric motor.

9. The printing machine claimed in claim 1, wherein said overturning shovel is rotatable about the axis of a gear motor adapted to cause said overturning shovel to assume two positions spaced by 180°.

10. The printing machine claimed in claim 9, wherein the free end of said overturning shovel carries suction nozzles.

11. The printing machine claimed in claim 3, wherein each carriage is coupled to a link rotatable about an axis carried by said respective carriage and whose end opposite that by which said respective carriage is coupled to said respective link is connected to a crank driven by a digitally controlled brushless electric motor or said two cranks are driven by a single digitally controlled brushless electric motor.

12. The printing machine claimed in claim 1, wherein a loading system at said loading station includes a presentation system adapted to feed at least one stack of objects to said loading station and a transfer system operative between said presentation system and said printing table and equipped with at least one pick-up unit adapted to pick up an object on the stack present on said presentation device and then to put that object down on one of said object-stations of said printing table.

13. The printing machine claimed in claim 12, wherein said transfer system has three pick-up units spaced by 120°.

14. The printing machine claimed in claim 12, wherein said presentation system includes a circular contour plate rotatable stepwise about an axis parallel to the rotation axis of said printing table and having a plurality of circumferentially distributed object-stations each adapted to receive a stack support.

15. The printing machine claimed in claim 12, further including an offloading system at said offloading station, said offloading system including a transfer system and associated therewith an evacuation system adapted to accumulate at least one stack of objects and to move it away from said offloading station.

16. The printing machine claimed in claim 1, wherein there is an even number of said workstations.

17. The printing machine claimed in claim 1, wherein said printing table has an odd number of said object-stations and a working area of each said workstation corresponds to an even number of said object-stations.

* * * * *